US006227548B1

(12) United States Patent
Netzer

(10) Patent No.: US 6,227,548 B1
(45) Date of Patent: May 8, 2001

(54) SEAL FOR MACHINE PARTS THAT RECIPROCATE RELATIVE TO ONE ANOTHER

(75) Inventor: Jürgen Netzer, Burscheid (DE)

(73) Assignee: CR Elastomere GmbH, Leverkusen (DE)

( * ) Notice: Subject to any disclaimer, the term of this patent is extended or adjusted under 35 U.S.C. 154(b) by 0 days.

(21) Appl. No.: 09/137,312

(22) Filed: Aug. 21, 1998

(30) Foreign Application Priority Data

Aug. 21, 1997 (DE) ..... 197 36 321

(51) Int. Cl.[7] ..... F01L 3/08

(52) U.S. Cl. ..... 277/502; 277/909; 277/576; 277/572

(58) Field of Search ..... 277/502, 909, 277/908, 551, 576, 572

(56) References Cited

U.S. PATENT DOCUMENTS

| | | | | |
|---|---|---|---|---|
| 4,773,363 | | 9/1988 | Stritzke . | |
| 4,811,703 | | 3/1989 | Rericha et al. . | |
| 4,909,202 | * | 3/1990 | Binford | 277/502 |
| 4,947,811 | * | 8/1990 | Binford | 277/502 |

FOREIGN PATENT DOCUMENTS

| | | |
|---|---|---|
| 1 899 855 | 9/1964 | (DE) . |
| 24 44 792 | 4/1976 | (DE) . |
| 0 392 893 | 10/1990 | (EP) . |
| 0 405 750 | 1/1991 | (EP) . |

OTHER PUBLICATIONS

Hans Deuring, Ventilschaftdichtringe und ihr Langzeitverhalten in Otto– und Dieselmotoren MTZ Motortechnische Zeitschrift, 43 (1982) 12.

* cited by examiner

*Primary Examiner*—Anthony Knight
*Assistant Examiner*—Enoch E Peavey
(74) *Attorney, Agent, or Firm*—Burns, Doane, Swecker & Mathis, L.L.P.

(57) ABSTRACT

A seal such as a valve shaft seal for use with machine parts that reciprocate relative to each other includes an elastomer sealing lip adapted to rest with a radial spring preload on one machine part and a sleeve-shaped holder carrying the sealing lip and projecting axially beyond the sealing lip for serving to simultaneously attach the seal to a second machine part. To provide a seal with a relatively uncomplicated and inexpensive holder that ensures a safe and flawless attachment and centering, the portion of the holder projecting axially beyond the sealing lip is provided with at least one projection that is directed essentially at an angle towards the inside for engaging a recess in the outer surface of the second machine part.

18 Claims, 1 Drawing Sheet

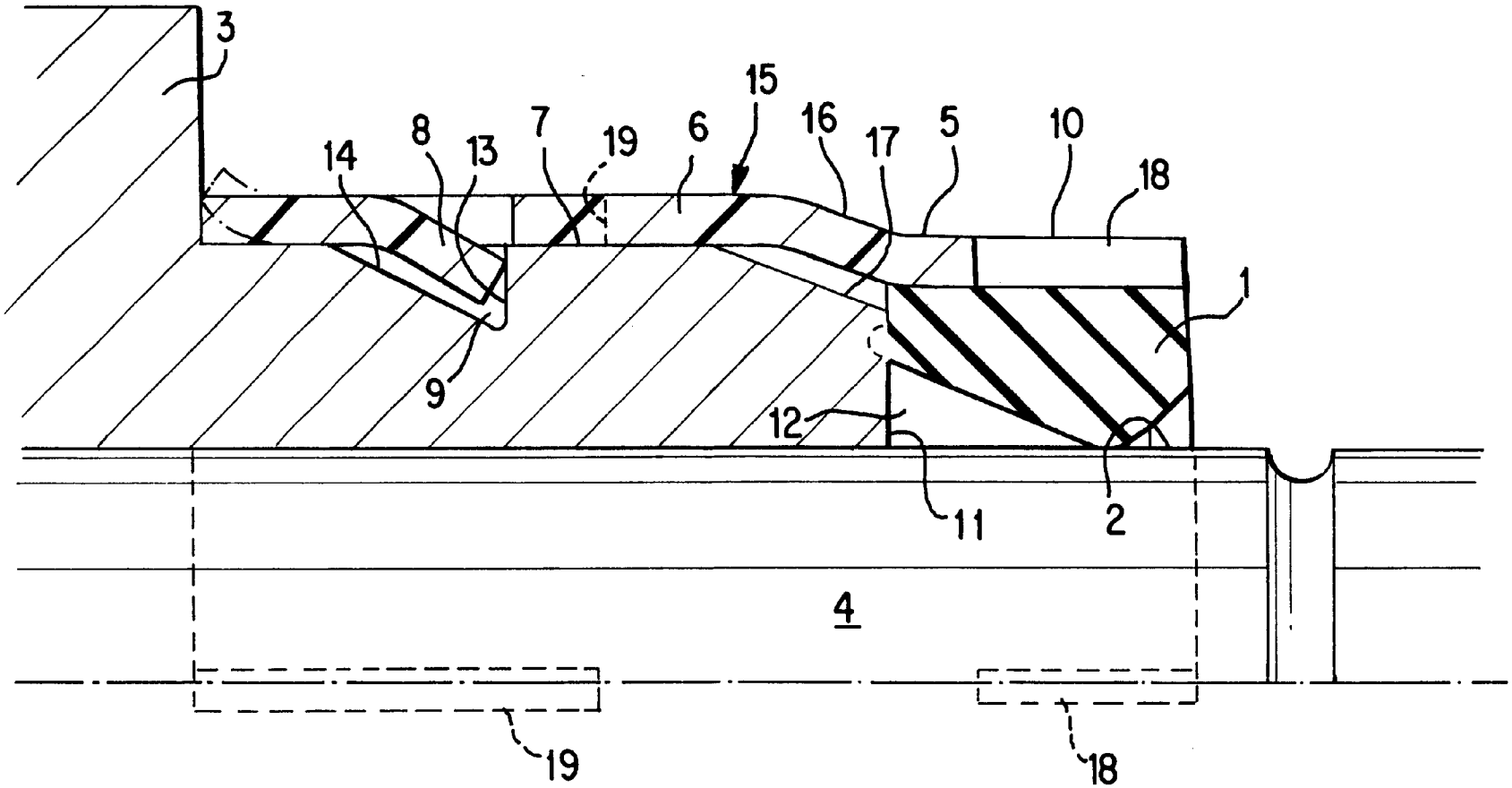
1
2
3
4
5
6
7
8
9
10
11
12
13
14
15
16
17
18
18
19
19

SEAL FOR MACHINE PARTS THAT RECIPROCATE RELATIVE TO ONE ANOTHER

This application corresponds to and claims priority under 35 U.S.C. § 119 with respect to German Application No. P 19736321.0 filed on Aug. 21, 1997, the entire content of which is incorporated herein by reference.

FIELD OF THE INVENTION

The present invention generally relates to seals for use in connection with machine parts. More particularly, the present invention pertains to a valve shaft seal for use in machine parts that reciprocate relative to one another.

BACKGROUND OF THE INVENTION

EP-0 392 893 A1 discloses a valve shaft seal including a sealing ring attached by means of a sleeve-shaped holder on a valve shaft guide. The sleeve-shaped holder has a double-folded flange for supporting the valve spring on the side facing away from the sealing ring. A number of tabs engage an annular groove at the radially inside free end of the lowest flange part. This known holder has a complicated construction and is therefore difficult to manufacture. In addition, the tabs are provided at the end of the holder and so the holder easily tilts when relatively short seating areas are provided.

A need thus exists for a seal having a relatively simple and inexpensive holder which ensures a safe and flawless attachment and centering of the seal.

SUMMARY OF THE INVENTION

In light of the foregoing, one aspect of the present invention involves a valve shaft seal mounted on machine parts that reciprocate relative to each other. The valve shaft seal includes an elastomer sealing lip resting with a radial preload on the outer surface of the first machine part and a sleeve-shaped holder mounted on the second machine part. The holder includes a first section and a second section, with the first section of the holder carrying the sealing lip and the second section projecting axially beyond the sealing lip. The second section of the holder is outfitted with at least one inwardly extending projection that engages a recess formed in an outer surface of the second machine part.

The projection that is directed at an angle towards the inside and engages with a recess in the outer surface of the second machine part ensures a safe, form-fitting attachment of the holder and thus of the seal itself at the machine part. It also ensures a flawless centering of the seal relative to the machine part.

The projection axially fixes the seal and is preferably provided in the center area of the axially projecting second section of the holder so that a support that extends over a larger annular surface results, thus preventing angled orientation or canting of the seal.

The projection can be relatively simply formed by, for example, notching the cylindrical second section of the holder. Also, the corresponding recess in the second machine part is preferably formed as an annular groove, thus eliminating the need for peripheral alignment.

A softer adjustment of the radial characteristic force of the sealing lip can be achieved by providing the holder in the first section that carries the sealing lip with at least one axially extending slit. Such a slit can also be provided in the projecting second section of the holder to facilitate the sliding of the holder onto the machine part while also ensuring that the holder is pressed against the machine part. To further facilitate the sliding of the holder onto the machine part, the end of the holder facing away from the sealing lip can be expanded outwardly in a trumpet-shape.

According to another aspect of the invention, a valve shaft seal for use with first and second machine parts that reciprocate relative to each other includes an elastomer sealing lip that is adapted to rest with a radial preload on the first machine part and a sleeve-shaped holder adapted to be mounted on the second machine part, the holder including a first section and a second section, the first section of the holder carrying the sealing lip and the second section projecting axially beyond the sealing lip, the holder in the second section being provided with at least one inwardly extending projection that is adapted to engage a recess provided in an outer surface of the second machine part.

Another aspect of the invention involves a seal for providing a seal in connection with machine parts that reciprocate relative to each other. The seal includes a sleeve-shaped holder and a sealing lip, with the sealing lip being mounted on the holder and extending inwardly for resting on a first machine part while a portion of the holder extends beyond the sealing lip for being mounted on a second machine part. A portion of the holder is provided with at least one inwardly extending projection for engaging a recess provided in an outer surface of the second machine part.

BRIEF DESCRIPTION OF THE DRAWING FIGURE

Further features and characteristics of the present invention will become more apparent from the following detailed description considered with reference to the accompanying drawing figure which is a longitudinal cross-section of the valve shaft seal according to the present invention mounted on a valve shaft and valve shaft guide.

DETAILED DESCRIPTION OF THE INVENTION

The valve shaft seal according to the present invention is adapted to be used in connection with machine parts that reciprocate relative to one another. The valve shaft seal 15 of the present invention includes a cylindrically-shaped or sleeve-shaped holder 5 and a sealing lip 1. The holder can be manufactured from plastic material while the sealing lip 1 can be manufactured from elastomer material.

The axially extending cylindrical holder 5 includes a first section 10 at which is located the sealing lip 1 and an axially extending sleeve-shaped second section 6. The first section 10 and the second section 6 are connected by a tapering section 16.

The sealing lip 1 is in the form of a radially inwardly extending sealing lip 1 which rests under a radial pre-load in a sealing manner on the outer surface 2 of a valve shaft 4. The valve shaft 4 is adapted to reciprocate in relation to the surrounding valve shaft guide 3. The sealing lip 1 is attached to and extends radially inwardly from the inner surface of the cylindrical holder 5, i.e., from the inner surface of the first section 10 of the holder 5. The sealing lip 1 is attached to the holder 5 by extrusion, molding, vulcanizing, etc.

At least one inwardly extending projection 8 is provided in the sleeve-shaped second section 6 of the holder 5. The projection 8 is located generally in the central area of the second section 6 between the sealing lip and the end of the holder 5 facing away from the sealing lip 1. The projection 8 preferably extends inwardly at an angle and is able to flex outwardly upon application of an outwardly directed force. The projection 8 can be formed by a material section notched from the second section 6 of the holder 5, although a projection operating in a manner similar to that described below can be embodied in other forms. Also, more than one projection can be provided in the second section 6 of the holder.

The outer surface 7 of the valve shaft guide 3 is provided with an annular groove 9. This annular groove 9 is defined by a generally perpendicular wall 13 and an inclined wall 14. The inclined wall 14 extends from the bottom of the perpendicular wall 13 to the outer surface 7 of the valve shaft guide 3.

The entire unit or valve shaft seal 15 consisting of the sealing lip 1 and the holder 5 is pushed up onto the outer surface 7 of the valve shaft guide 3. The somewhat flexible projection 8 deflects outwardly as the sleeve section 6 moves along the outer surface 7 of the valve shaft guide 3. The valve shaft seal 15 eventually reaches a position where the projection 8 moves into and engages the annular groove 9. At this point, the valve shaft seal 15 is axially fixed in place by the engagement of the projection 8 with the groove 9.

The radial preload of the sealing lip 1 is exerted by the first section 10 of the holder 5 that is pulled radially inwardly. It is also possible to provide, as is known, an annular spring for purposes of exerting a pre-load force. Another possibility is to provide one or more axially extending slits 18 in the first section 10 carrying the sealing lip 1.

The sealing lip 1 is provided at the end facing the axially facing front face 11 of the valve shaft guide 3 with an axially projecting, annular sealing lip 12 which rests with a pre-load against the front face 11, thus forming a static seal. The sealing lip 12 is shown in the drawing figure in dotted outline because the illustrated configuration of the sealing lip 12 is the non-deformed state.

The projecting second section 6 of the holder 5 can also be provided with one or more axially extending slits 19. The slits 19 in the second section 6 are positioned at circumferential locations different from the circumferential location(s) of the projection(s) 8.

It is also possible to expand the free end of the second section 6 to possess a trumpet shape as illustrated by the dot-slash lines in the drawing figure. This alternative can help facilitate the axial sliding of the holder 5 onto the valve shaft 3, thus allowing for the possibility of eliminating the insertion angle or tapered end surface 17.

As noted, the holder 5 can be fabricated from plastic material, preferably a tough plastic material. However, the holder can also be manufactured from, for example, steel plate. Also, the projections, in addition to being formed by notching, can be shaped by stamping or molding or extruding. A seal in which the holder is manufactured from plastic material has the advantage that it can be manufactured completely in one part with the sealing lip in a two-component extruder.

The seal of the present invention is quite advantageous in several respects. The projection that is directed inwardly at an angle for engaging a recess in the outer surface of the second machine part ensures a safe, form-fitting attachment of the holder and thus of the seal itself at the machine part. It also advantageously ensures that the seal is centered relative to the machine part.

The projection which axially fixes the seal is provided at a portion of the holder (i.e., the center area of the axially projecting second section of the holder) which is designed to provide a support that extends over a larger annular surface. In this way angled orientations or canting of the seal is prevented.

The projection can be rather easily formed and thus does not require a significant manufacturing operations. Also, the corresponding recess in the second machine part that receives the projection is preferably formed as an annular groove, thus eliminating the need for peripheral alignment.

By providing axial slits in the first section of the holder that carries the sealing lip, a softer adjustment of the radial characteristic force of the sealing lip can be achieved. Providing a similar slit in the projecting second section of the holder facilitates the sliding of the holder onto the machine part while also ensuring that the holder is pressed against the machine part. The outward expansion of the end of the holder facing away from the sealing lip further facilitates this sliding of the holder onto the machine part.

The invention can be used advantageously in particular for valve shaft seals, but other applications are also conceivable.

The principles, preferred embodiments and manner of use of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. The combination of a shaft seal and first and second machine parts that reciprocate relative to each other, the valve shaft seal comprising an elastomer sealing lip resting with a radial preload on an outer surface of the first machine part and a sleeve-shaped holder mounted on the second machine part, the holder including a first section and a second section, the first section of the holder carrying the sealing lip and possessing an axially extending free end portion provided with at least one slit which extends axially from said free end portion toward said second section, the second section of the holder being provided with at least one inwardly extending projection that engages a recess formed in an outer surface of the second machine part, the outer surface of the second machine part including a first outer surface portion located on one side of the recess and a second outer surface portion located on the opposite side of the recess, the first outer surface portion being located closer to the first section of the holder than the second outer surface portion, the second section of the holder including an axially extending portion that engages the second outer surface portion of the second machine part.

2. The combination according to claim 1, wherein the projection is located in a center area of the second section between the sealing lip and an end of the holder facing away from the sealing lip.

3. The combination according to claim 1, wherein the recess in the outer surface of the second machine part is an annular groove.

4. The combination according to claim 1, wherein the projection in the holder is formed by a material section notched from the second section.

5. The combination according to claim 1, wherein the second section of the holder is provided with at least one axially extending slit.

6. The combination according to claim 1, wherein the second section includes an end that is outwardly expanded.

7. The combination according to claim 1, wherein the holder is manufactured from plastic.

8. The combination according to claim 1, wherein the first machine part is a valve shaft and the second machine part is a valve shaft guide.

9. A shaft seal for use with first and second machine parts that reciprocate relative to each other, comprising an elastomer sealing lip adapted to rest with a radial preload on the first machine part and a sleeve-shaped holder adapted to be mounted on the second machine part, the holder including a first section and a second section, the first section of the holder carrying the sealing lip and possessing an axially extending free end portion provided with at least one slit which extends axially from said free end portion toward said second section, the holder in the second section being provided with at least one inwardly extending projection that is adapted to engage a recess provided in an outer surface of the second machine part, the second section of the holder including an axially extending portion located on a side of the inwardly extending projection that is remote from the first section.

10. The shaft seal according to claim 9, wherein the projection is located in a center area of the second section between the sealing lip and an end of the holder facing away from the sealing lip.

11. The shaft seal according to claim 9, wherein the projection in the holder is formed by a material section notched from the second section.

12. The shaft seal according to claim 9, wherein the second section of the holder is provided with at least one axially extending slit.

13. The shaft seal according to claim 9, wherein the second section includes an end that is outwardly expanded.

14. The shaft seal according to claim 9, wherein the holder is manufactured from plastic.

15. A seal for providing a seal in connection with machine parts that reciprocate relative to each other, comprising a sleeve-shaped holder and a sealing lip, the sealing lip being mounted on a first section of the holder and extending inwardly for resting on a first machine part while a second section of the holder extends beyond the sealing lip to be mounted on a second machine part, said second section of the holder being provided with at least one inwardly extending projection for engaging a recess provided in an outer surface of the second machine part; and wherein said first section of the holder possesses an axially extending free end portion provided with at least one axially extending slit which extends from said free end portion toward said at least one inwardly extending projection.

16. The seal according to claim 15, wherein the projection is located between the sealing lip and an end of the holder facing away from the sealing lip.

17. The seal according to claim 15, wherein the projection in the holder is formed by a material section notched from the second section.

18. The seal according to claim 15, wherein seal is a valve shaft seal.

* * * * *